US007240742B2

(12) United States Patent
Sewell et al.

(10) Patent No.: US 7,240,742 B2
(45) Date of Patent: Jul. 10, 2007

(54) PIPE HANDLING SYSTEM WITH A MOVABLE MAGAZINE

(75) Inventors: Cody L. Sewell, Perry, OK (US); Ricky G. Porter, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 323 days.

(21) Appl. No.: 10/946,632

(22) Filed: Sep. 21, 2004

(65) Prior Publication Data

US 2006/0060382 A1 Mar. 23, 2006

(51) Int. Cl.
*E21B 19/14* (2006.01)

(52) U.S. Cl. ..... 175/52; 175/85; 414/22.62

(58) Field of Classification Search ..... 175/52, 175/85; 166/85.1; 414/22.62, 22.65
See application file for complete search history.

(56) References Cited

U.S. PATENT DOCUMENTS

| | | | | |
|---|---|---|---|---|
| 5,556,253 | A | 9/1996 | Rozendaal et al. | 414/797.7 |
| 5,607,280 | A | 3/1997 | Rozendaal | 141/745.7 |
| 5,954,209 | A | 9/1999 | Wurm et al. | 211/70.4 |
| 6,074,153 | A * | 6/2000 | Allen | 414/22.53 |
| 6,085,852 | A | 7/2000 | Sparks et al. | 175/52 |
| 6,179,065 | B1 * | 1/2001 | Payne et al. | 175/24 |
| 6,189,628 | B1 | 2/2001 | Jenne | 175/52 |
| 6,332,502 | B1 | 12/2001 | Mills et al. | 175/52 |
| 6,419,029 | B2 * | 7/2002 | Bayer et al. | 172/52 |
| 6,533,046 | B2 | 3/2003 | Mills et al. | 175/52 |
| 6,543,551 | B1 | 4/2003 | Sparks et al. | 175/52 |
| 6,637,525 | B2 | 10/2003 | Watanabe et al. | 175/52 |
| 6,814,164 | B2 | 11/2004 | Mills et al. | 175/52 |
| 7,018,164 | B2 * | 3/2006 | Anthis et al. | 414/797.7 |
| 2002/0153169 | A1 | 10/2002 | Sewell | 175/52 |

FOREIGN PATENT DOCUMENTS

| | | |
|---|---|---|
| WO | WO 00/75479 A1 | 12/2000 |
| WO | WO 01/33035 A1 | 5/2001 |

OTHER PUBLICATIONS

Barbco, Inc. "Barbco Directional Drilling", cover of brochure, including nine (9) pages of photos of Barbco BD50-15SC model, 2001.

* cited by examiner

*Primary Examiner*—William Neuder
(74) *Attorney, Agent, or Firm*—Tomlinson & O'Connell PC

(57) ABSTRACT

An pipe handling assembly for transporting pipe sections to and from a horizontal boring machine. The system comprises a movable magazine, a support member, a drive system, and a transfer assembly. The drive system may move the magazine laterally on the support member or may pivot the magazine. The transfer assembly transfers pipe sections between the magazine and the spindle connection area. The magazine and the support frame are disposed above the spindle connection area such that only empty columns of the magazine are outside of the footprint of the boring machine.

27 Claims, 10 Drawing Sheets

PIPE HANDLING SYSTEM WITH A MOVABLE MAGAZINE

FIELD OF THE INVENTION

The present invention relates generally to the field of horizontal directional drilling, and in particular to pipe handling systems for loading and unloading pipes on a horizontal boring machine.

SUMMARY OF THE INVENTION

The present invention comprises a pipe handling device for storing and transporting pipe sections to and from a spindle axis of a horizontal boring machine. The pipe handling device comprises a support member having a first end and a second end, a discharge point at the first end of the support member, a magazine, and a transfer assembly. The support member is positioned such that the support member is located above the spindle axis and such that the first end is on a first side of the spindle axis and the second end is on a second side of the spindle axis. The magazine has a plurality of columns to receive and store pipe sections parallel to the spindle axis and is movable between a plurality of positions. The plurality of positions of the magazine are defined by the position of the magazine when different columns of the magazine are aligned with the discharge point. The support member prevents pipe sections from being discharged from each of the plurality columns that stores a pipe section and is not aligned with the discharge point. The transfer assembly is moveable between at least a first position and a second position. The transfer assembly comprises a pipe delivery member. In the first position the pipe delivery member is aligned with the discharge point and in the second position the pipe delivery member is aligned with the spindle axis.

In an alternative embodiment, the present invention comprises a pipe handling device for storing and transporting pipe sections to and from a spindle axis of a horizontal boring machine. The pipe handling device comprises a magazine, a base member, and a transfer system. The magazine has a first side, an opposed second side, and a plurality of adjacent columns to receive and store pipe sections including a first column immediately adjacent the first side. The magazine is moveable along a path of travel between an initial discharge position, in which the first column is aligned with a discharge point below the magazine, and a final discharge position, in which the column immediately adjacent the second side is aligned with the same discharge point. The path of travel of the magazine has a footprint which overlays the spindle axis over at least a portion of the path of travel. The base member is positionable beneath the magazine and has a blocking surface which blocks discharge of pipes from the base of the magazine in any column closer to the second side than the column aligned with the discharge point, while permitting a pipe in the column aligned with the discharge point to discharge from a base of the column and move to the discharge point. The transfer system is adapted to move a discharged pipe from the discharge point to the spindle axis.

In yet another embodiment the invention comprises a method for transferring pipe sections to a horizontal boring machine from a magazine having a plurality of adjacent columns for storing pipe sections. The method comprises moving the magazine such that a column of the magazine containing pipe sections is aligned above a discharge point, retrieving a pipe section from the discharge point, moving the retrieved pipe section to the horizontal boring machine while blocking further pipe sections from being discharged to the discharge point, and maintaining any columns having pipe sections within the tracks of the horizontal boring machine.

BRIEF DESCRIPTION OF THE DRAWINGS

FIG. 6 is an elevation view of the pipe handling assembly of FIG. 4, with a lift arm of a dispensing assembly engaging the pipe sections.

FIG. 9 is an elevation view of the pipe handling assembly of FIG. 8, with the magazine moved to position a different column of pipe above the discharge point.

DETAILED DESCRIPTION OF THE PREFERRED EMBODIMENTS

Horizontal boring machines are used to install utility services or other products underground. Horizontal directional drilling eliminates surface disruption along the length of the project, except at the entry and exit points, and reduces the likelihood of damaging previously buried products. Skilled and experienced crews have greatly increased the efficiency and accuracy of boring operations. However, there is a continuing need for more automated boring machines which reduce the need for operator intervention and thereby increase the efficiency of boring underground.

The boring operation is a process of using a boring machine to advance a drill string through the earth along a desired path. The boring machine generally comprises a frame, a drive system mounted on the frame and connected to one end of the drill string, and a boring tool connected to the other end of the drill string. The drive system provides thrust and rotation needed to advance the drill string and the boring tool through the earth. The drill string is generally comprised of a plurality of drill pipe sections joined together at threaded connections. As the boring operation proceeds, the drill string is lengthened by repeatedly adding pipe sections from a pipe magazine to the drill string.

When the boring operation is completed, the drill string is pulled back through the borehole during a backreaming operation, generally with the utility line or product to be installed underground connected to the end of the drill string. During this backreaming operation, pipe sections are removed from the drill string as the drill string gets shorter. Each time a pipe section is taken from the drill string, the pipe section is replaced into the magazine. As is the case with the addition of pipe sections to the drill string, the process is repetitive. As one skilled in the art will appreciate, efficient and economic mechanisms for adding and removing pipe sections are a present need in the industry.

Figure 1:
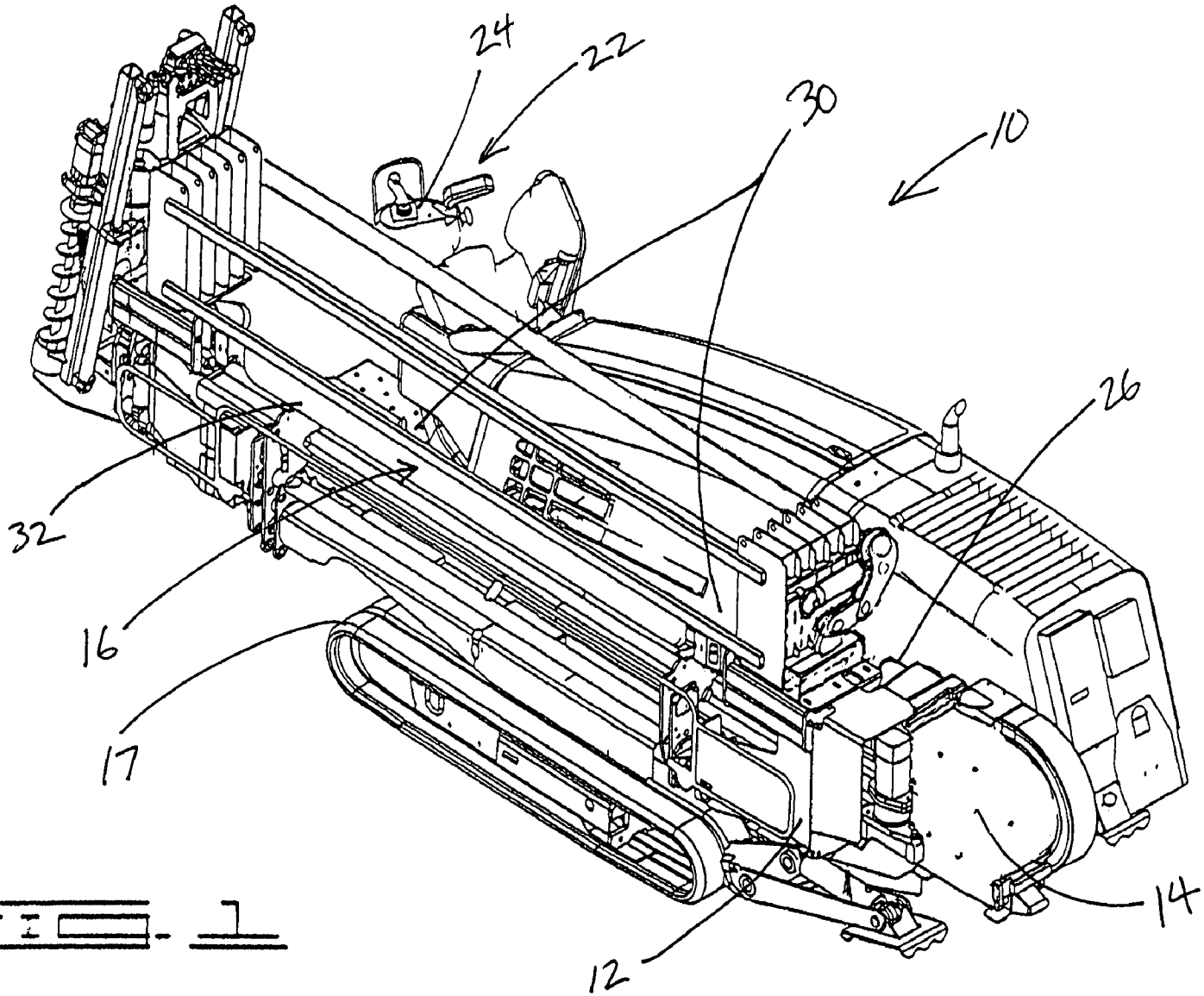
FIG. 1 is a perspective view of a horizontal boring machine with a pipe handling system in accordance with the present invention.

Turning now to the drawings in general and FIG. 1 in particular, there is shown therein a horizontal boring machine in accordance with the present invention. The boring machine, designated generally by reference numeral 10, generally comprises a frame 12, a drive system 14 supported on the frame, a pipe handling system 16 supported on the frame, a plurality of tracks 17, a drill string (not shown), and a directional boring tool (not shown). The boring machine 10 is operated and monitored with controls located at an operator's console 22. The operator's console 22 may contain a control panel 24 having a display, joystick, and other machine function control mechanisms, such as switches and buttons. From the control panel 24, each of the underlying functions of the boring machine 10 can be controlled. The display on the control panel 24 may include a digital screen and a plurality of signaling devices, such as gauges, lights, and audible devices, to communicate the status of the operations to the operator.

The drive system 14 is connected to the drill string by way of a spindle 26. The spindle 26 preferably comprises a threaded spindle pipe joint for connection to a threaded pipe joint on the end of a pipe section 28 (shown in FIG. 4). As used herein, a pipe joint can be either of the male or female threaded ends of a pipe section 28. One skilled in the art will appreciate that the drill string is formed of a plurality of individual pipe sections 28 connected together at threaded pipe joints.

As the boring machine 10 bores the borehole and the drill string is lengthened, additional pipe sections 28 are added or "made up." As part of the makeup operation, a pipe section 28 is transported to a spindle connection area 30 by a pipe handling assembly 32. The spindle connection area 30 represents the area of the boring machine 10 where the drive system 14 engages the pipe section 28 of the drill string. The drive system 14 moves and engages the pipe section along a spindle axis 34 (shown in FIG. 4). Other aspects of the machine 10 and operation not pertinent to the present invention function to lubricate and secure the pipe section 28 to the drill string. The boring operation can then continue by advancing the drill string 18 along a desired bore path.

When the boring operation is complete, the backreaming operation typically is performed. During the backreaming operation, pipe sections 28 are removed from the drill string or "broken out." As part of the breakout operation, other aspects of the machine 10 remove the pipe section 28 in the spindle connection area 30 from the drill string. The pipe section 28 is removed from the spindle connection area 30 by the pipe handling assembly 32. The backreaming operation can then continue by pulling the drill string back through the borehole.

Figure 2:
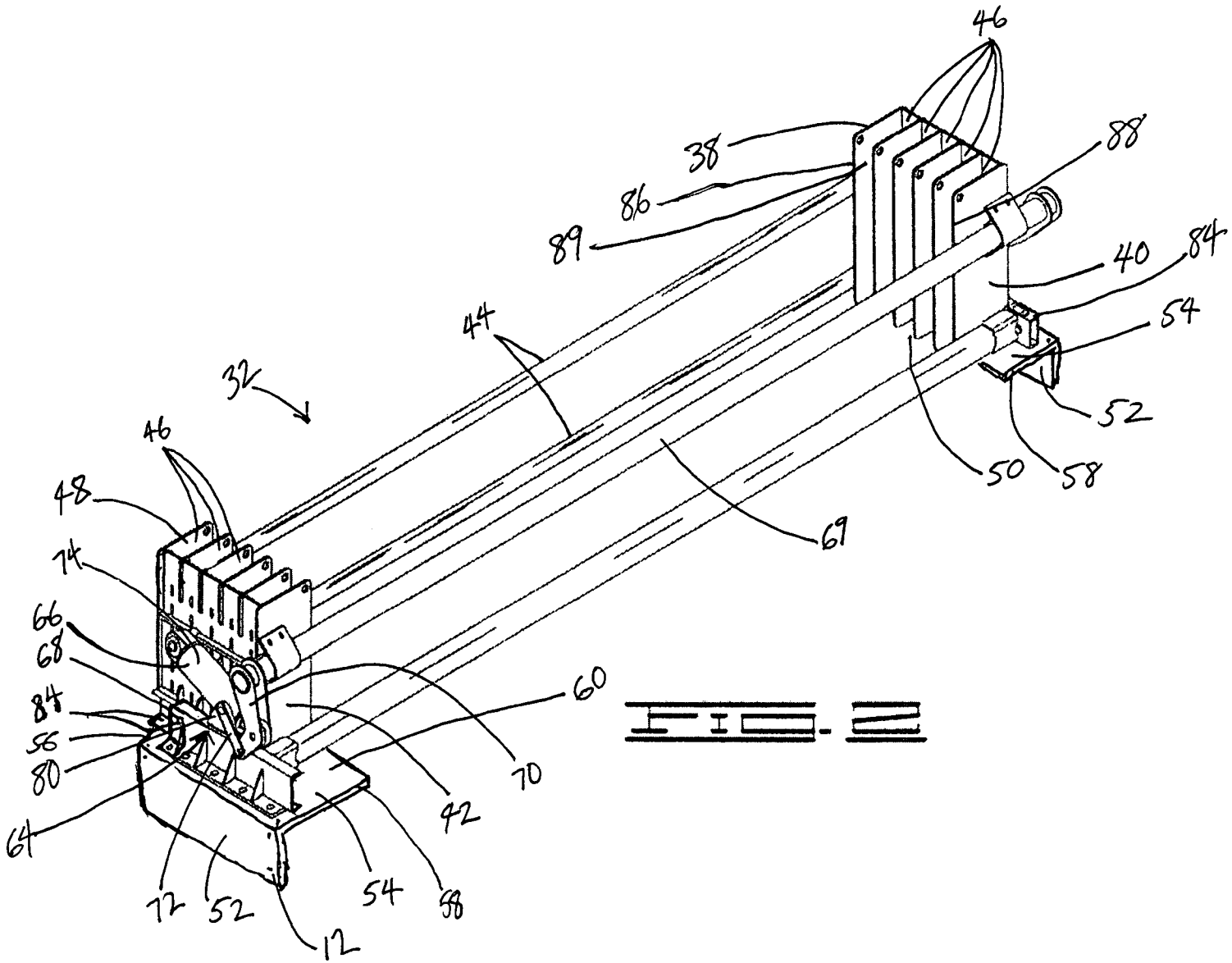
FIG. 2 is a perspective view of a movable magazine for use with the pipe handling system of the present invention.
Figure 3:
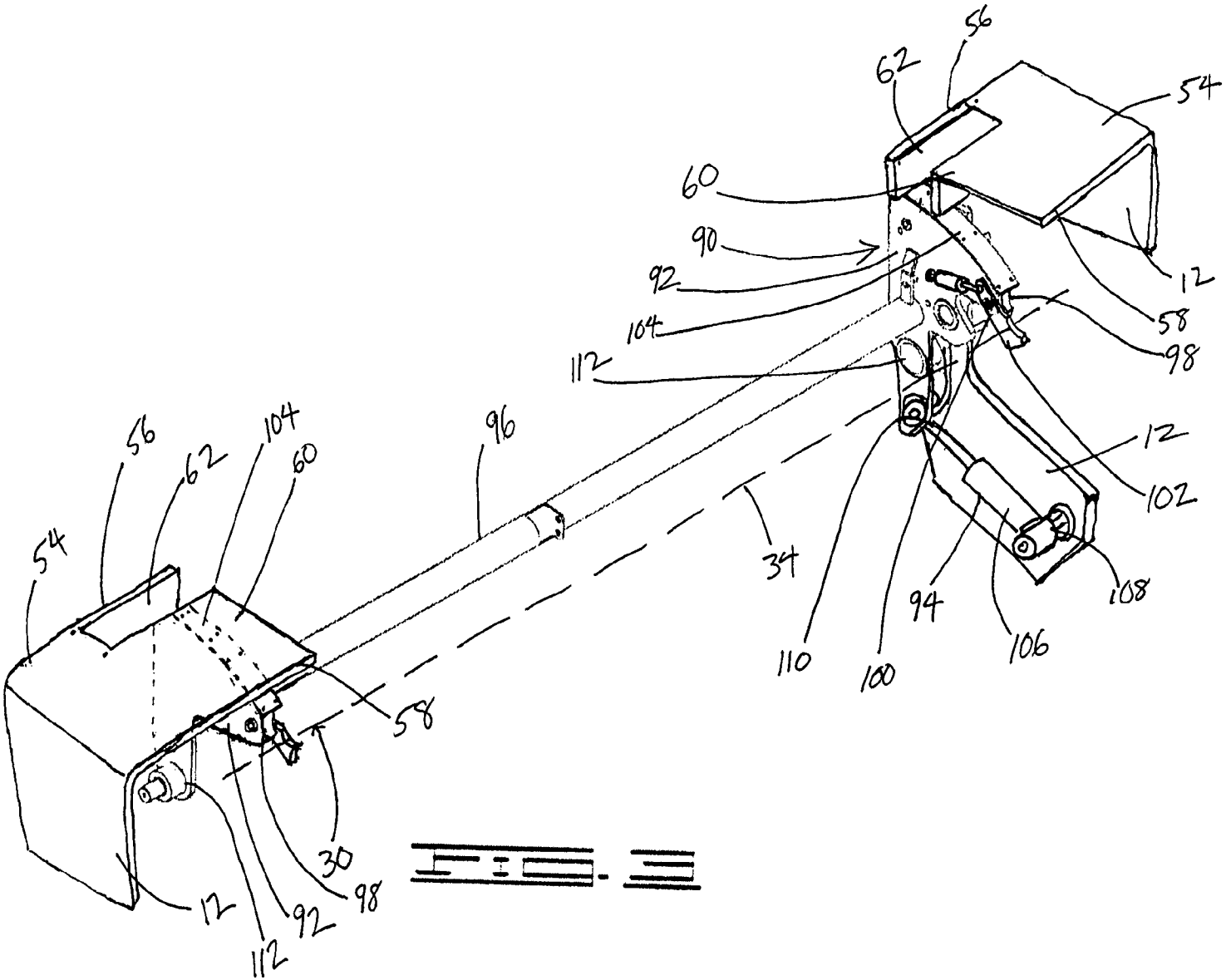
FIG. 3 is a perspective view of the transfer assembly for use with the pipe handling system of the present invention.

A preferred embodiment for the pipe handling assembly 32 of the present invention is shown in more detail in FIGS. 2 and 3. As shown therein, the pipe handling assembly 32 comprises a magazine 38 having a plurality of columns for storing and receiving pipe sections 28. The magazine 38 comprises first and second end pieces 40 and 42 joined by one or more cross bars 44. Each of the end pieces 40 and 42 is preferably shaped to form a plurality of channels 46. The opposing channels 46 in the end pieces 40 and 42 form the plurality of adjacent columns for storing the pipe sections 28. The cross bars 44 provide stability to the magazine 38 and keep the end pieces 40 and 42 aligned to form the columns for the pipe sections 28. The end pieces 40 and 42 each have an open top 48 and an open bottom 50, permitting pipe sections 28 to be placed in or removed from the magazine 38 through the top or bottom. Preferably, a plurality of retaining pins (not shown) are used to keep pipe sections 28 from being inadvertently discharged from the magazine 38.

Referring now to FIG. 3, the pipe handling assembly 32 further comprises a frame 52 having a support member 54 having a first end 56 and a second end 58 and which is positioned beneath the magazine 38. The support member 54 is preferably secured to the frame 12 of the boring machine 10. More preferably, the support member 54 is positioned above the spindle connection area 30 such that the first end 56 of the support member is on a first side of the spindle axis 34 and the second end 58 of the support member is on a second side of the spindle axis. The support member 54 further has a blocking surface 60 which blocks discharge of pipe sections 28 in columns directly above the support member. As to be discussed further below, a discharge point 62 is preferably located at the first end 56 of the support member 54 where pipe sections 28 are discharged from the magazine 38.

With reference again to FIG. 2, the pipe handling assembly 32 further comprises a drive system 64 operatively connected to the magazine 38 and adapted to move the magazine 38 relative to the support member 54. As shown in the embodiment of FIG. 2, the drive system 64 comprises a linkage assembly 66 and a roller assembly 68. Preferably, the drive system 64 will comprise a linkage assembly 66 and a roller assembly 68 at each end of the magazine 38. In the preferred embodiment, a crossbar 69 operatively connects the linkage assembly 66 at each end of the magazine 38 to assist the coordinated movement of the magazine.

The linkage assembly 66 comprises a lever arm 70, a lever link 72 and a cylinder 74. The lever arm 70 has a first end pivotally attached to the magazine 38 and a second end connected to the lever link 72. The lever link 72 is connected between the second end of the lever arm 70 and the support member 54 or the frame 12 of the boring machine 10. The lever link 72 allows for adequate movement of the linkage assembly 66 and consequently the magazine 38. As shown in FIG. 2, the lever link 72 is connected to the support member 54 at an eyelet 80 attached to the support member 54. The cylinder 74 is attached at a first end to the magazine 38 and at a second end 6 to the lever arm 70.

The roller assembly 68 facilitates movement of the magazine 38 relative to the support member 54. Preferably, the roller assembly 68 comprises a plurality of roller guides 84 and associated rollers. A set of roller guides 84 is preferably disposed at each end of the magazine 38. The set of roller guides 84 at each end of the magazine 38 comprises a roller guide secured to the support member 54 and a mated roller guide on the magazine 38. A plurality of rollers (not seen), such as ball bearings, are disposed within the set of roller guides 84. One skilled in the art will appreciate that as the cylinder 74 is extended or retracted the force from the cylinder will cause the magazine 38 to slide along the roller guide 84 attached to the support member 54.

In an alternative embodiment, the mated roller guide attached to the magazine 38 in the embodiment of FIG. 2 can instead be secured to a cradle (not shown). The cradle would support the magazine 38, permitting the magazine to be removed when it is empty and replaced with a magazine full of pipe sections 28. Use of a cradle embodiment provides additional options for connection and operation of the drive system 64. One skilled in the art will appreciate the drive system 64 may be removably attached to the magazine 38, or may be operatively connected only to the cradle.

With continued reference to the embodiment shown in FIG. 2, operation of the drive system 64 serves to move the magazine 38 between a plurality of positions in which the plurality of columns of the magazine are aligned with the discharge point 62. With the magazine 38 above the support member 54, the discharge point 62 is preferably located at the first end 56 of the support member. A first side 86 of the magazine 38 is proximate the first end 56 of the support member 54 and an opposing second side 88 of the magazine is proximate the second end 58 of the support member. The magazine 38, then, has a first column 89 immediately adjacent the first side 86 of the magazine. Preferably, the path of travel of the magazine 38 includes an initial discharge position in which the first column 89 of the magazine is aligned with the discharge point 62. When pipe sections 28 in the first column 89 have been removed and added to the drill string 18, the magazine 38 is moved to another position in which a second column of the magazine, immediately adjacent the first column, is aligned with the discharge point 62. The movement of the magazine 38 is repeated as successive columns are emptied until a final discharge position is reached in which the column of the magazine immediately adjacent the second side 88 of the magazine is aligned with the discharge point 62. One skilled in the art will appreciate a footprint of the magazine overlays the spindle axis 34 over a least a portion of the path of travel if the support member 54 is positioned above the spindle axis as previously described. This path of travel also permits a more advantageous center of gravity of the boring machine 10, where the columns of the magazine 38 containing pipe sections 28 never extend beyond the tracks of the boring machine.

With reference now to FIG. 3, the pipe handling assembly 32 further comprises a transfer assembly 90 adapted to move a pipe section 28 between the discharge point 62 and the spindle connection area 30. Preferably, the transfer assembly 90 is adapted to move between at least a first position in which the transfer assembly is aligned with the discharge point 62 and a second position in which the transfer assembly is aligned with the spindle axis 34. The transfer assembly 90 comprises at least one transfer member 92 movably supported on the frame 12 and a drive assembly 94 for driving the movement of the transfer member. Where more than one transfer member 92 is used, a crossbar 96 or other linking structure can be used so the plurality of transfer members move in a coordinated fashion. Alternatively, separate drive assemblies could be used for the plurality of transfer members 92.

In the preferred embodiment shown in FIG. 3, the transfer member 92 comprises a pipe delivery member 98. The pipe delivery member 98 is adapted to receive and secure a pipe section 28 as the transfer assembly 92 moves between the first position and the second position. Preferably, the delivery member 98 further comprises a pipe grip 100 operatively connected to the pipe delivery member and adapted to secure the pipe section 28 on the pipe delivery member. More preferably, the pipe grip 100 comprises a hydraulically activated retaining arm 102. The arm 102 secures the pipe section 28 in the pipe delivery member 98 when the pipe section is transported between the discharge point 62 and the spindle connection area 30. In alternative embodiments (not shown) the pipe grip 100 may comprise a spring activated arm, a cam activated mechanism, or magnets to secure the pipe section 28 to the pipe delivery member 98.

The transfer member 92 further comprises a blocking surface 104. The blocking surface 104 is preferably adjacent the pipe delivery member 98 such that the blocking surface prevents discharge of pipes 28 from the magazine 38 and the discharge point 62 when the pipe delivery member is not aligned with the discharge point. Thus, when transfer member 92 is in the first position the pipe delivery member 98 is aligned with the discharge point 62. When the transfer member 92 is in the second position, the pipe delivery member 98 is aligned with the spindle axis 34 and the blocking surface 104 is aligned with the discharge point 62 to prevent discharge of pipe sections 28 from the magazine 38.

Figure 4:
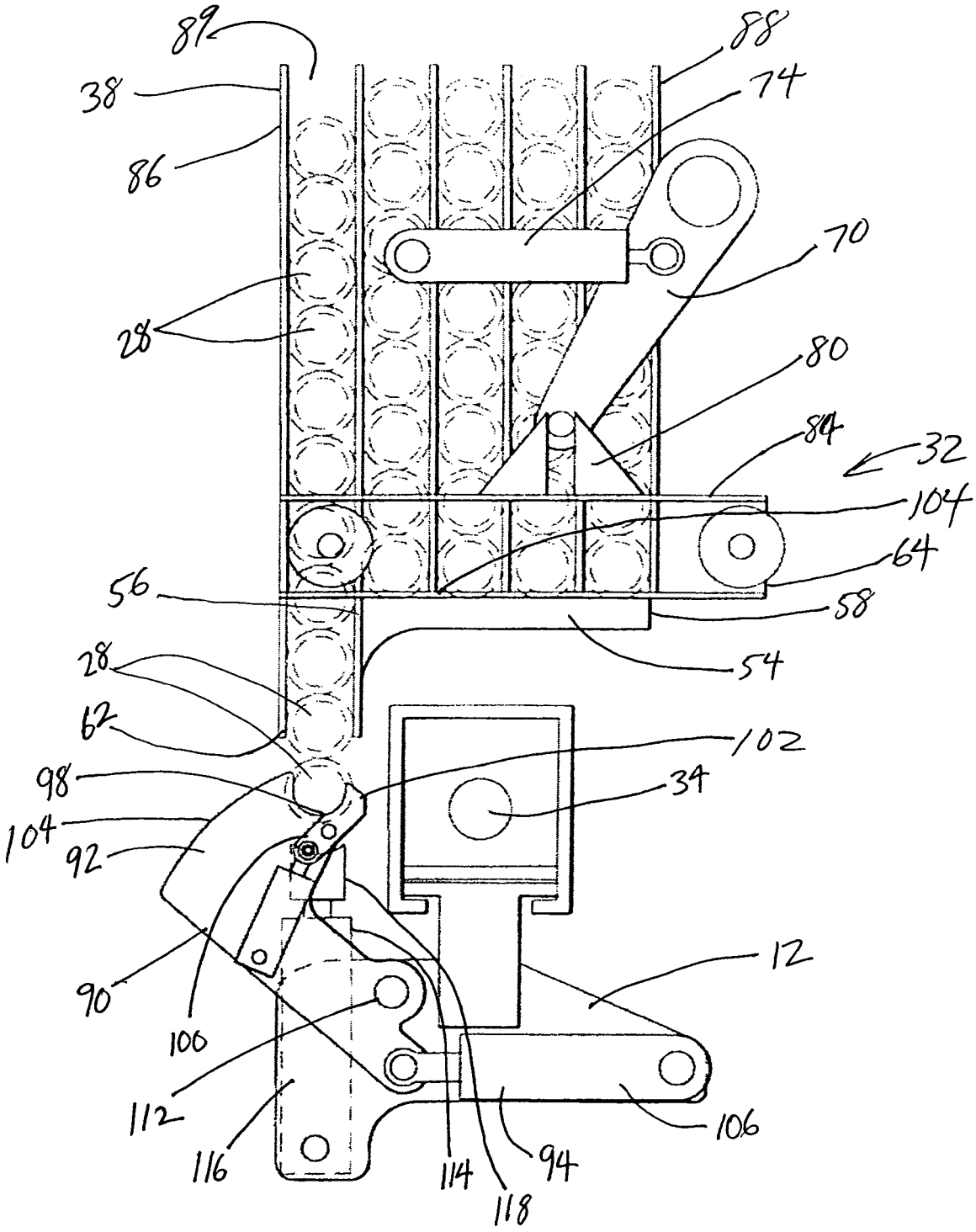
FIG. 4 is a end elevation view of the pipe handling assembly of the present invention, showing the transfer assembly in a first position at the discharge point.
Figure 5:
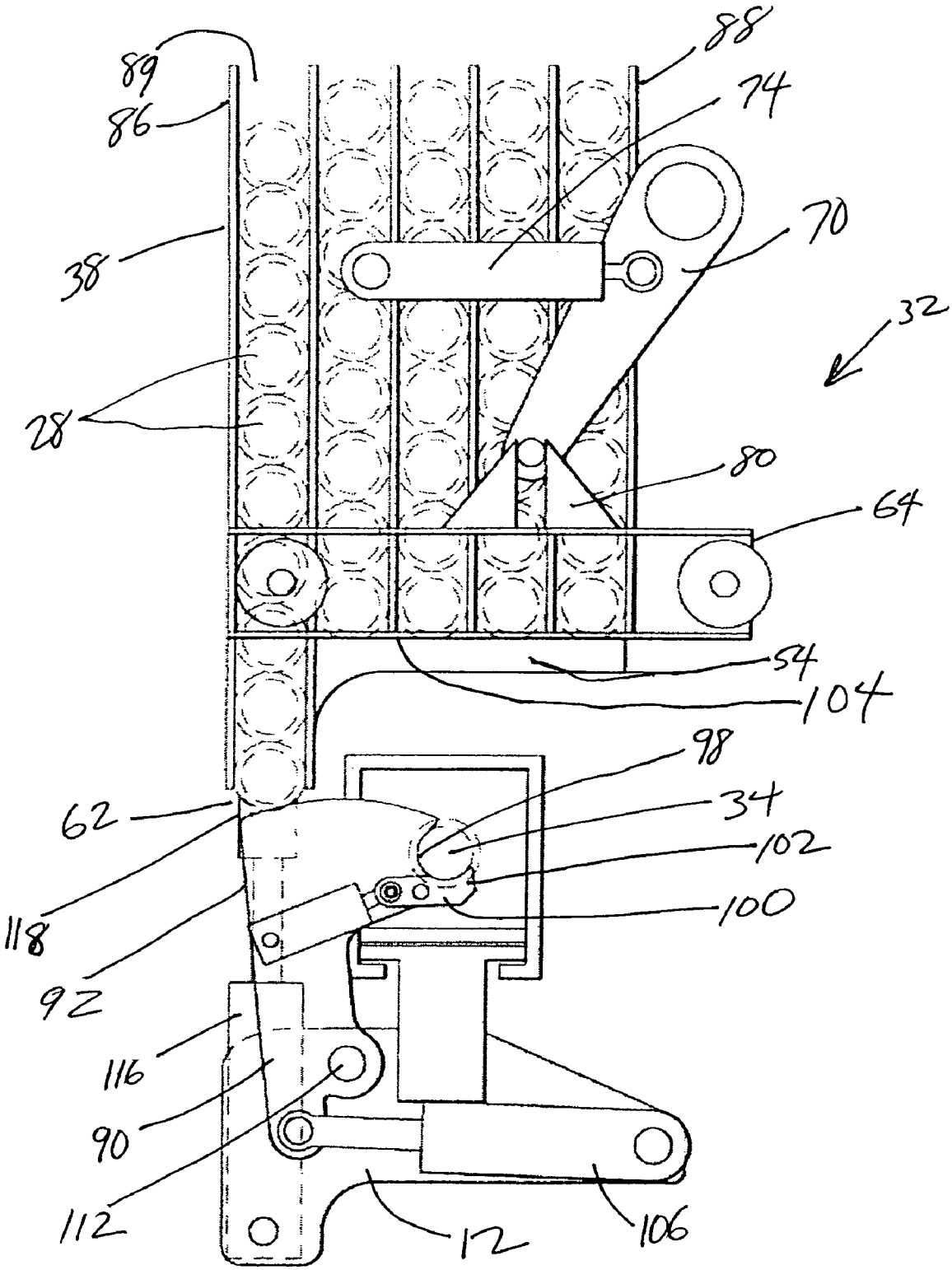
FIG. 5 is an elevation view of the pipe handling assembly of FIG. 4, with the transfer assembly in a second position and aligned with the spindle axis.
Figure 5:
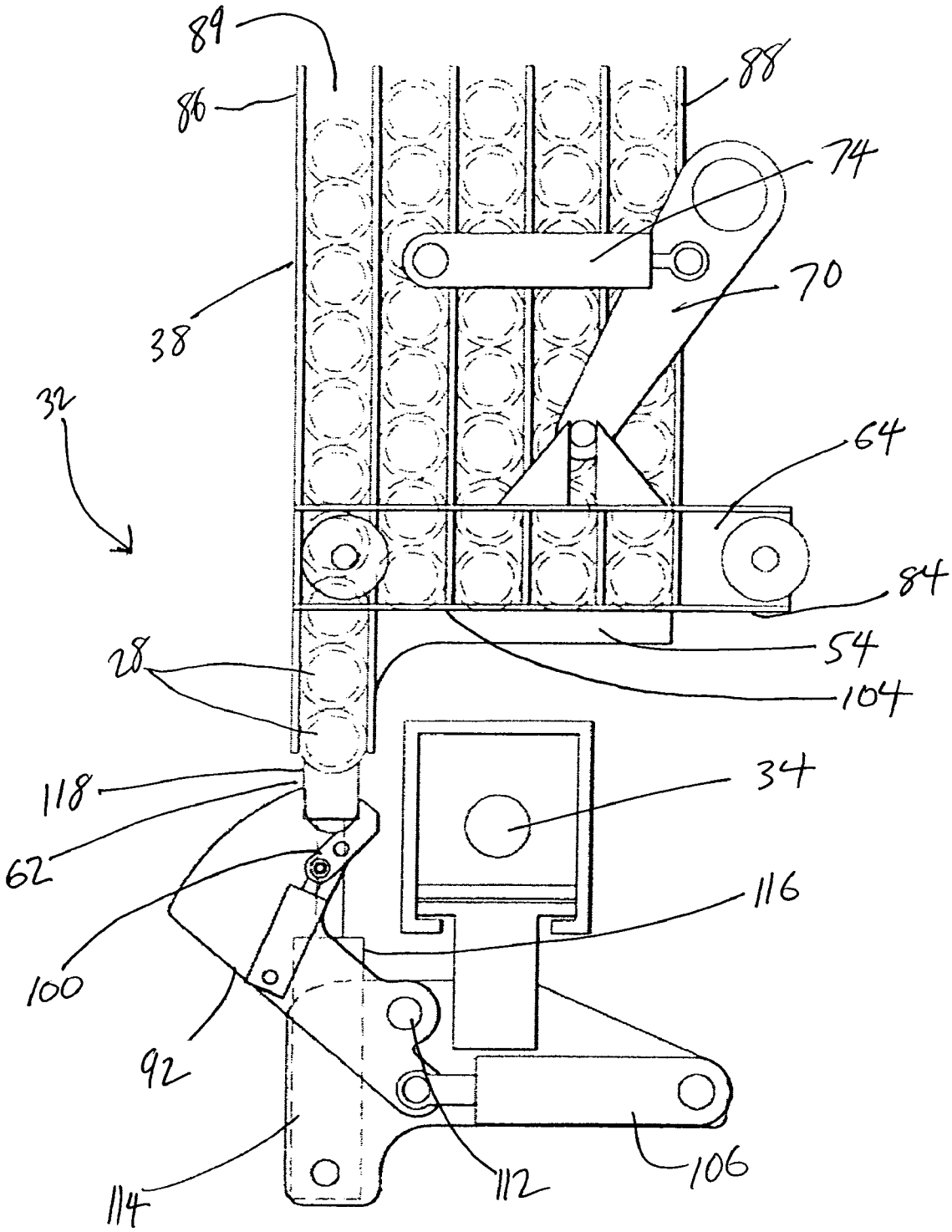

The drive assembly 94 is preferably a hydraulic cylinder 106 operatively connected to the transfer member 92. The hydraulic cylinder 106 is secured to the frame 14 at a first end 108 and to the transfer member 92 at a second end 110. In the preferred embodiment, the drive assembly 94 will operate to pivot the transfer member about a pivot point 112. As shown in FIG. 4, in the first position, the pipe delivery member 98 is aligned with the discharge point 62. With reference now to FIG. 5, the transfer member 92 is shown in the second position, with the pipe delivery member 98 aligned with the spindle axis 34 and the blocking surface 104 aligned with the discharge point 62. The hydraulic cylinder 106 is shown extended in FIG. 5, having caused the transfer member 92 to pivot about the pivot point 112.

With reference now to FIGS. 4 and 5, the pipe handling assembly 32 further comprises a dispensing system 114 adapted to limit and control discharge of pipes 32 at the discharge point 62 and to return pipes from the discharge point back to the magazine 38. The dispensing system 114 preferably comprises a hydraulic cylinder 116 and a lift arm 118 operatively connected to the cylinder. The lift arm 118 is movable between a plurality of positions by operation of the cylinder 116. In a lower position, as shown in FIG. 4, the lift arm 118 is retracted and does not contact any pipe sections 28. In a lift position, shown in FIG. 5, the lift arm 118 is extended to lift the pipe sections 28 from the discharge point 62 off of the transfer member 92. In this way the lift arm 118 functions to remove the added weight of pipe sections 28 from the blocking surface 104, limiting unwanted wear on the transfer member 92.

The lift arm 118 also may be used in this way to lower the next pipe section 28 from the magazine 38 into the pipe delivery member 98 at the discharge point 62. Referring now to FIG. 6, the transfer member 92 is shown in the first position, with the pipe delivery member 98 again aligned with the discharge point 62. Here, the pipe delivery member 98 is again positioned to receive a pipe section 28 from the discharge point 62 when the lift arm 118 is retracted, lowering the next pipe section to the delivery member. The position of the transfer member 90 in FIG. 6 could also represent use of the lift arm 118 to return a pipe section 28 that has been removed from the drill string 18 to the magazine 38. Thus, during the backreaming operation as the drill string 18 is shortened, the pipe delivery member 98 would transport a pipe section 28 from the drill string 18 at the spindle connection area 30 to the discharge point 62. The lift arm 118 would then be extended, to the position shown in FIG. 6 to return the pipe section 28 to the magazine 38.

Figure 7:
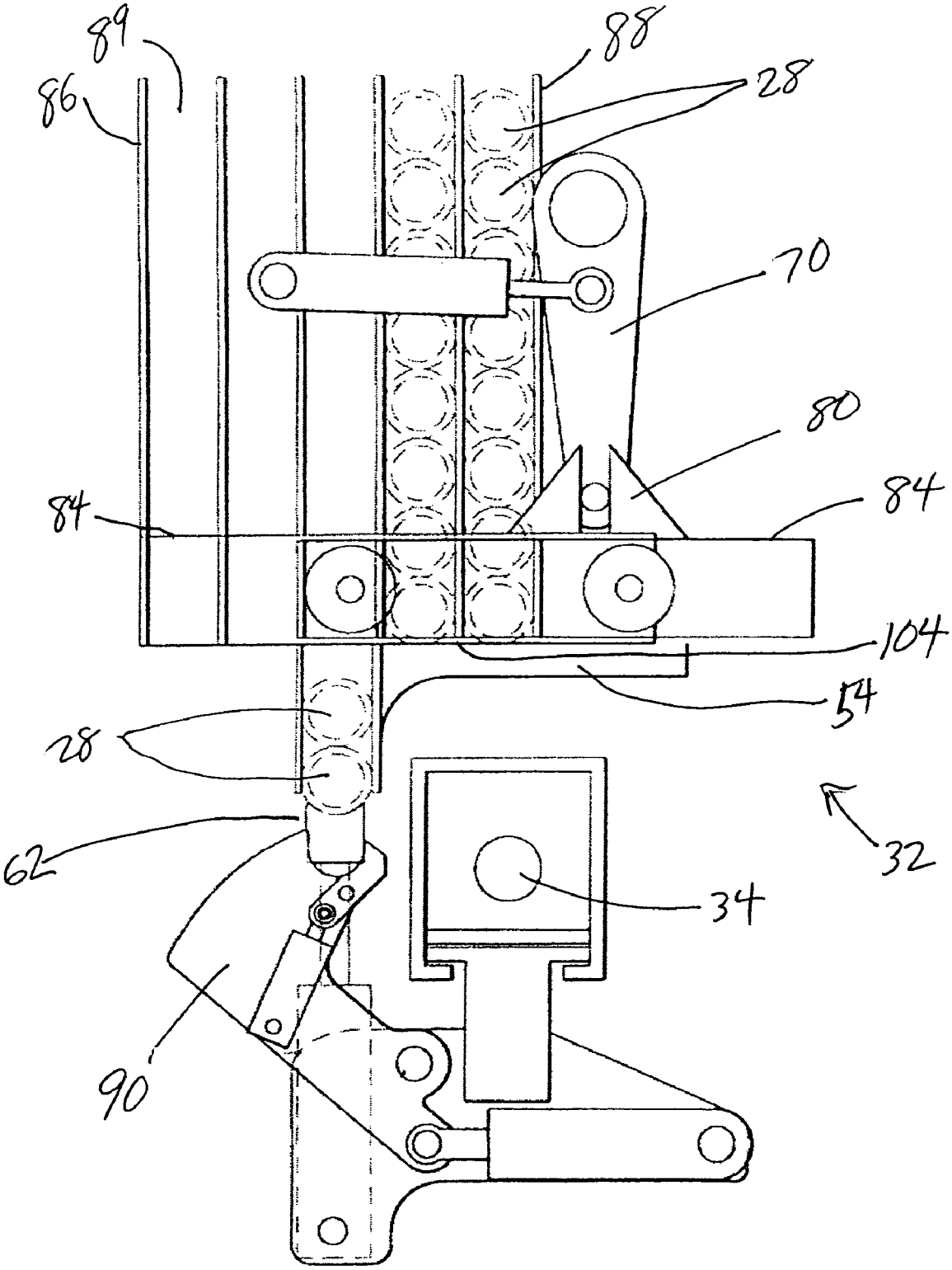
FIG. 7 is an elevation view of the pipe handling assembly of FIG. 4, with the magazine moved to position a different column of pipe above the discharge point.

As discussed previously, the transfer of pipe sections 28 between the magazine 38 and the spindle axis 34 can be repeated for each of the adjacent columns of the magazine. During a boring operation, as the drill string 18 is lengthened, the magazine 38 will be moved to a next full column of the magazine as a column is emptied. Similarly, the magazine 38 will be moved to a next empty column of the magazine during the backreaming operation as pipe sections 28 are returned to the magazine. Referring now to FIG. 7, as an example, the magazine 38 is shown moved to a position along its path of travel where a middle column of the magazine is aligned with the discharge point 62.

Figure 8:
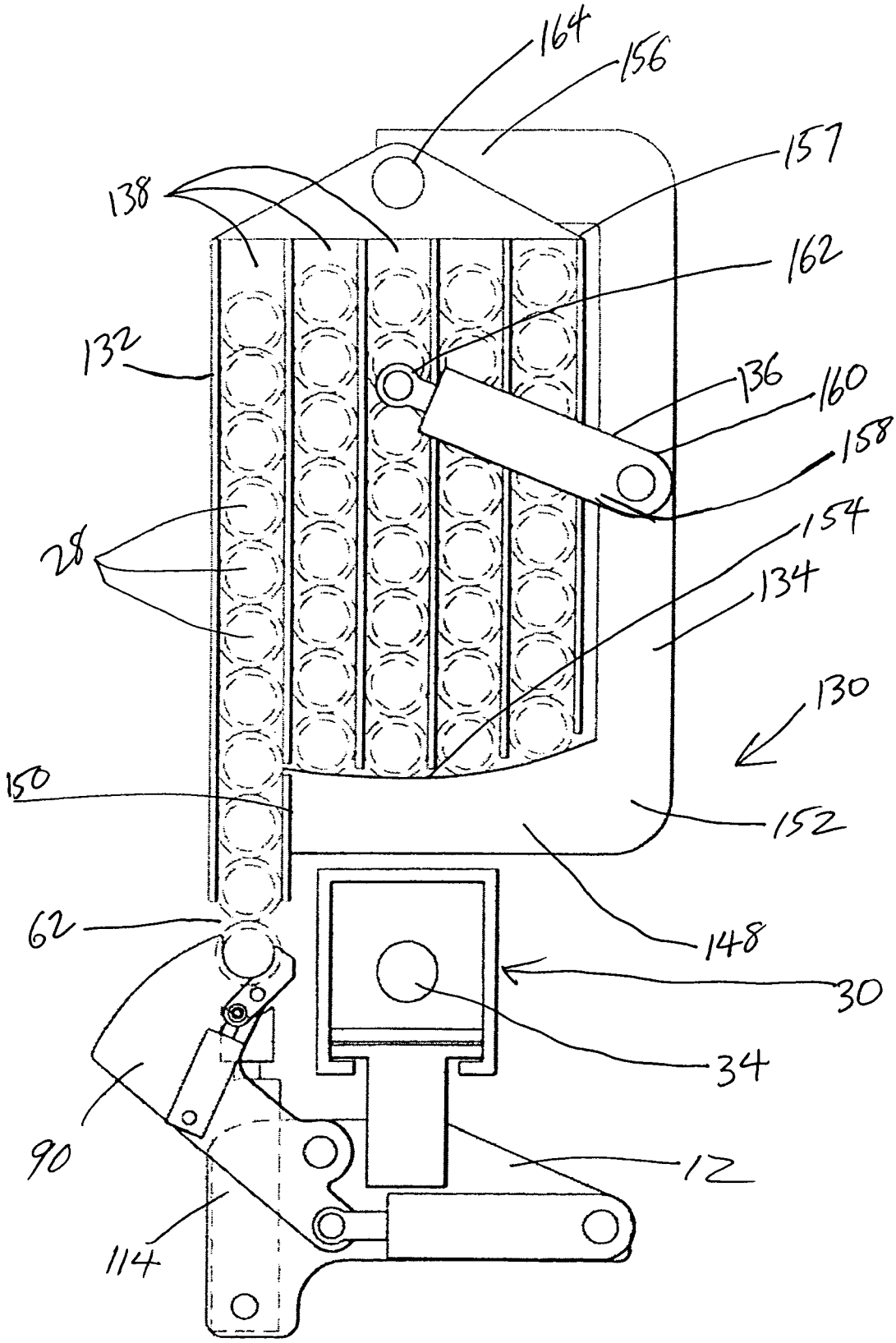
FIG. 8 is an alternative embodiment for the pipe handling assembly of the present invention.
Figure 3:
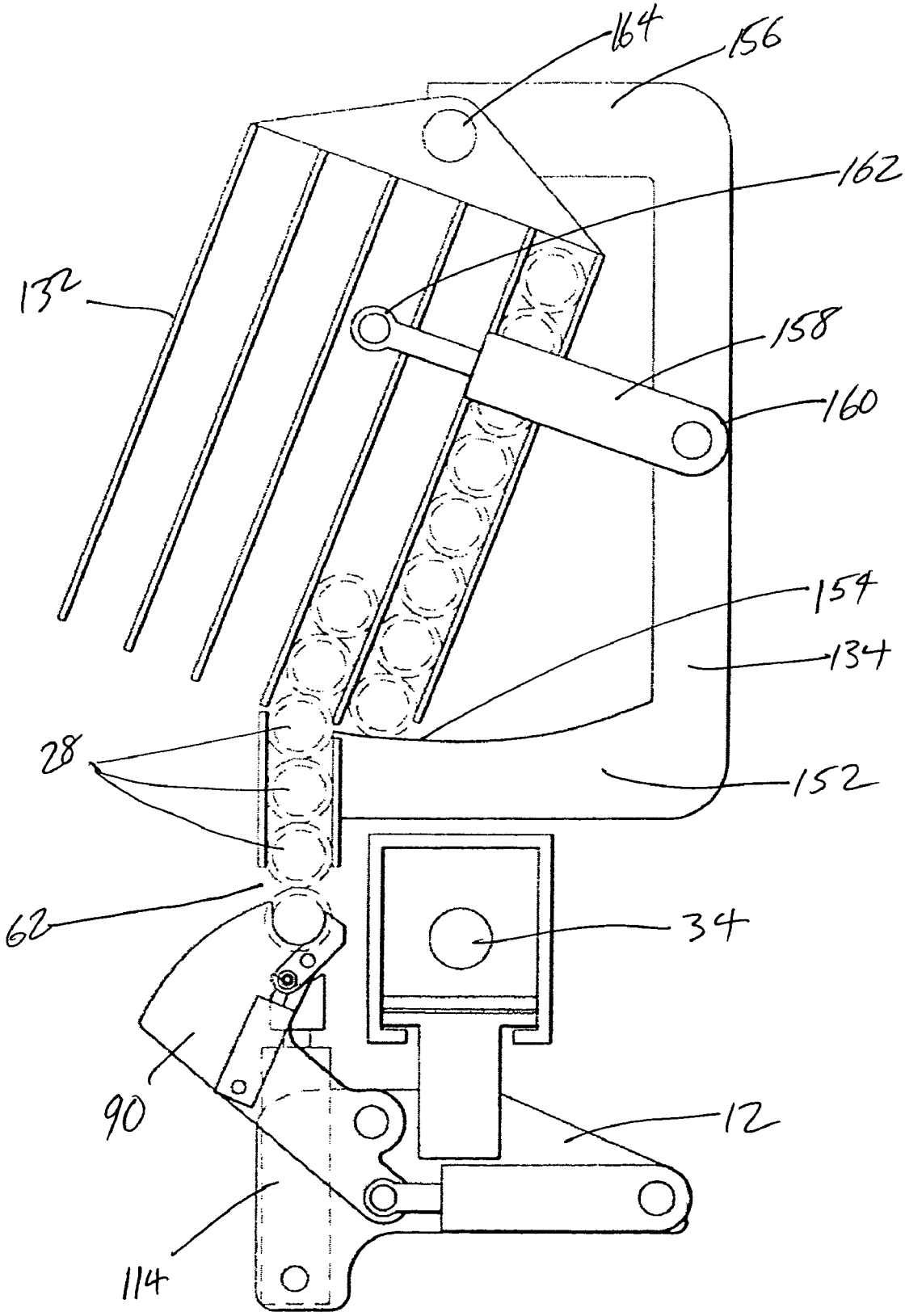

With reference now to FIG. 8, there is shown therein an alternative embodiment for the pipe handling assembly 130 of the present invention in which the magazine 132 is pivotally movable. In the alternative embodiment, the pipe handling assembly 130 comprises a magazine 132, a frame 134, and a drive system 136. The magazine 132 of the alternative embodiment has a plurality of adjacent columns 138 for storing and receiving pipe sections 28. The magazine 132 is similar to the magazine 38 of the embodiment shown in FIG. 2 and comprises first and second end pieces (not shown) joined by one or more cross bars (not shown). Each of the end pieces is preferably shaped to form a plurality of channels. The opposing channels in the end pieces form the plurality of adjacent columns 138 for storing the pipe sections 28. The end pieces again each have an open top and an open bottom, permitting pipe sections 28 to be placed in or removed from the magazine 132. Preferably, a plurality of retaining pins (not shown) are used to keep pipe sections 28 from being inadvertently discharged from the magazine 132 when not in use.

The frame 134 of the embodiment of FIG. 8 comprises a support member 148 having a first end 150 and a second end 152 and which is positioned beneath the magazine 132. Preferably, the support member 148 is positioned above the spindle connection area 30 such that the first end 150 of the support member is on a first side of the spindle axis 34 and the second end 152 of the support member is on a second side of the spindle axis. The support member 148 further has a blocking surface 154 which blocks discharge of pipe sections 28 in columns directly above the support member.

The frame 134 further comprises a magazine brace 156. The brace 156 is connectable to the magazine 132 such that the magazine is movably supported by the brace. As depicted in FIG. 8, the brace 156 is preferably connected to the magazine 132 proximate the top 157 of the magazine. The frame 134, including the support member 148 and the brace 156, are shown in a "C" shape, however any configuration for the frame with the support member below the magazine 132 and the brace pivotally supporting the magazine would be appropriate.

The drive system 136 is adapted to pivotally move the magazine 132. Preferably, the drive system 136 comprises a hydraulic cylinder 158. The cylinder 158 is attached at a first end 160 to the frame 134 of the pipe handling assembly 130 and at a second end 162 to the magazine 132. As the cylinder 158 extends and retracts, the magazine 132 is pivoted about a pivot point 164 where the magazine is supported at the brace 156. With reference now to FIG. 9, the magazine 132 is shown having been moved to a position in which another column of the magazine is aligned with the discharge point 62. Alternate drive systems for moving the magazine or the transfer arm include air, electric, ball screw or rack and pinion.

Figure 10:
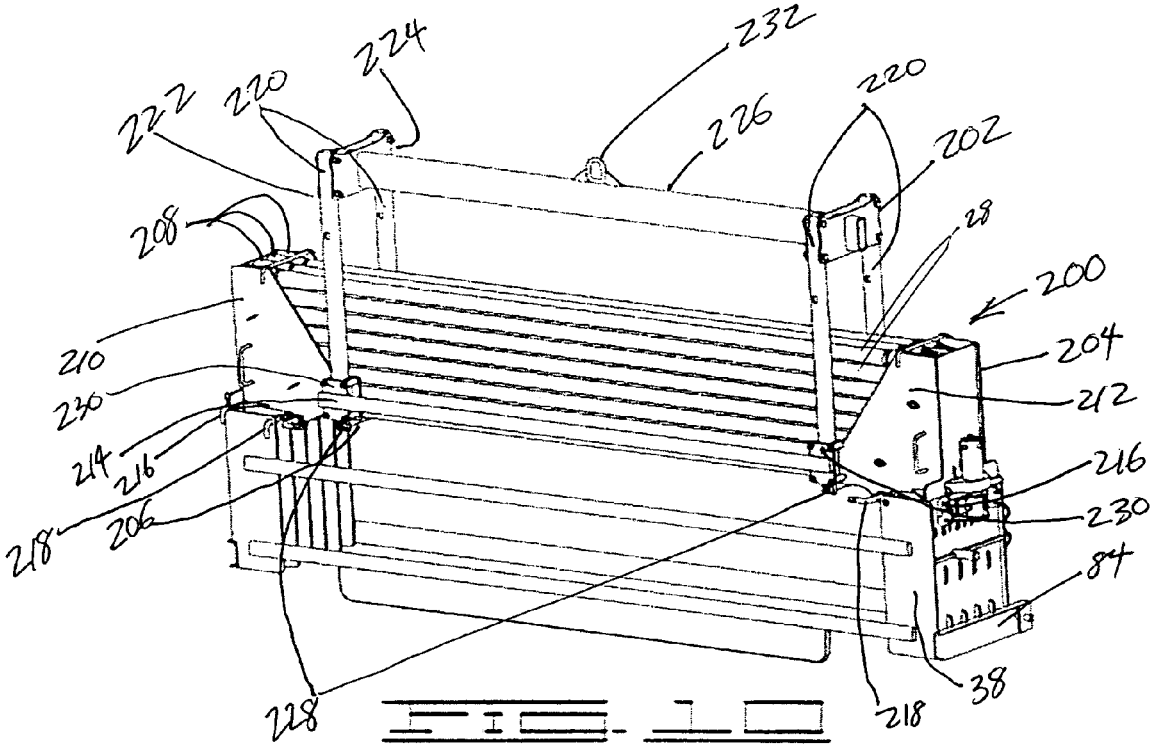
FIG. 10 is a perspective view of an auxiliary pipe assembly for use with the present invention.

With reference now to FIG. 10, the present invention also comprises an auxiliary pipe assembly 200 for providing additional pipe sections 28 to the pipe handling assembly 32. The auxiliary pipe assembly 200 comprises a movable load frame 202 and a cartridge 204 which store and transfer additional pipe sections 28 to and from the magazine 38. Preferably, the auxiliary pipe assembly 200 is adapted to be placed on top of the magazine 38 such that the columns of pipe sections 28 in the pipe cartridge 204 and load frame 202 are aligned with columns of the magazine. Alternatively, the auxiliary pipe assembly 200 may be adapted to transfer pipe sections 28 directly to and from one or more columns of the magazine 38. The auxiliary pipe assembly 200 of FIG. 10 is shown for use with the magazine 38 of the embodiment of FIG. 2, but the auxiliary pipe assembly could be used with any movable magazine. Other assemblies and methods of adding additional pipe sections to pipe handling systems are anticipated, including various replacement cartridges that can be placed on the moving pipe dispensing mechanism.

The cartridge 204 defines an open bottom 206 and a plurality of columns 208 to receive and store pipe sections 28. More preferably, the cartridge comprises opposing first and second end pieces 210 and 212 having column separators. One or more cross bars 214 are used to connect the first and second end pieces 210 and 212 and to provide stability for the cartridge 204. The cartridge 204 preferably comprises at least one securing pin 216 to maintain the cartridge in a position on top of the magazine 38. A plurality of retaining pins 218 may also be used proximate the bottom of the cartridge 204 to retain pipe sections 28 in the cartridge. In this way, the cartridge 204 may be used to store pip sections 28 remote from the boring machine 10 and the entire cartridge positioned on top of the magazine 38 when additional pipe sections are desired.

The load frame 202 comprises a plurality of guide posts 220 disposed to form a first 222 and a second side 224 of the load frame. Preferably, a pair of laterally spaced guide posts 220 are used for each the first side 222 and the second side 224 of the load frame 202. A top cross brace 226 joins and provides separation for the pairs of guide posts 220. A plurality of removable bottom support pins 228 connect guide posts 220 on the first side 222 and second side 224 of the load frame 202. The guide posts 220, cross brace 226, and support pins 228 form an open box configuration for the load frame 202.

The load frame 202 is disposed around the plurality of pipe sections 28 to be added to the magazine 38. In the preferred embodiment, the load frame 202 is disposed around the pipe sections 28 maintained in the cartridge 204. Preferably, the guide posts 220 of the load frame 202 are slidably supported by the cross bars 214 of the cartridge 204. More preferably, a plurality of slide channels 230 that receive the guide posts 220 may be secured to the cross bars 214 of the cartridge 204. The slide channels 230 permit the guide posts 220, and consequently the load frame 202, to slide vertically relative to the cartridge 204. Thus, if the retaining pins 218 are removed from the cartridge 204, the load frame 202 may be slidably lowered to lower the pipe sections 28 through the bottom 206 of the cartridge 204.

Figure 11:
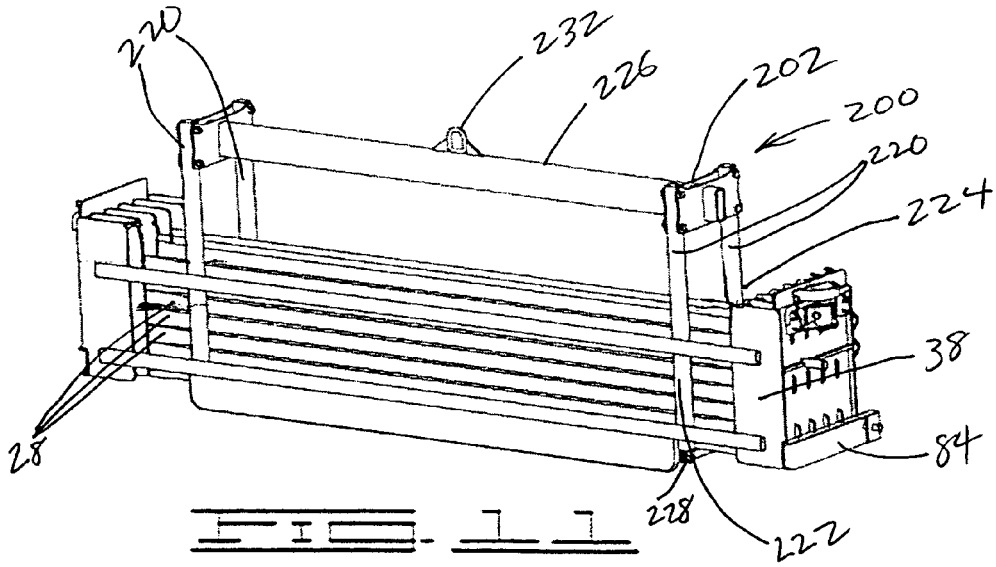
FIG. 11 is a perspective view of an alternative embodiment for an auxiliary pipe assembly for use with the present invention.

Although the load frame 202 is shown here for use with the cartridge 204, the load frame may also be used to load or remove at least one column of pipe sections 28 in the magazine 38 without the cartridge 204. FIG. 11, for example, shows the load frame 202 with pipe sections 28 positioned with the pipe sections added to the magazine 38. The application of FIG. 11 for the load frame 202 is also applicable for other columnar arrangements. The guide posts 220 may, for example, be separated by a distance sufficient enough to support only a single column of pipe sections 28. The column of pipe sections 28 could then be lowered into any chosen empty column of the magazine 38. Alternatively, the guide posts 220 may support a plurality of adjacent columns of pipe sections 28. The load frame preferably would have at least one spacer (not shown) to maintain the integrity of the columns. The plurality of columns can likewise be added to empty columns in the magazine 38, or removed from a plurality of full columns in the magazine.

As yet another alternative, the load frame 202 may support a plurality of columns not immediately adjacent to each other. The load frame 202 preferably comprises a plurality of interior post supports (not shown) to support and maintain the plurality of pipe sections in columnar fashion. The interior post supports would be disposed to maintain, for example, a column of pipe sections 28 immediately adjacent the first side 222 of the load frame 202. Other interior post supports would maintain a column immediately adjacent the second side 204 of the load frame 202. The plurality of columns could be separated by a distance equal to one or more unused columns.

The movement of the load frame 202 is preferably controlled by an external device or an assembly formed as part of the auxiliary pipe assembly 200. For example, an external crane (not shown) could be secured to a hook 232 on the cross brace 226 of the load frame 202 to lower the load frame and pipe sections 28 into the magazine 38. Alternatively, one or more hydraulic cylinders (not shown) or other mechanisms may be operatively connected to the guide posts 220 to slidably move the guide posts relative to the cartridge 204. One skilled in the art will appreciate that when the cartridge 204 and load frame 202 are placed on top of the magazine 38 or the cradle as previously described, the pipe sections 28 in the auxiliary pipe assembly can be transferred to the magazine.

Another method of transferring pipe sections 28 from the ground or from a trailer with the auxiliary pipe assembly 200 is with an integrally mounted lifting device. A crane like lifting device may consist of a single arm or a plurality of spaced apart telescoping arms protruding from the frame 12. The arms may move vertically from a lowered pickup point to a lifted delivery point above the magazine or cradle. The plurality of lift arms are spaced apart a distance greater than the length of the magazine allowing the auxiliary pipe assembly 200 to swing between the arms into position and to be lowered onto the magazine 38. The telescoping and lifting action are preferably accomplished with hydraulic cylinders. It is understood the same lifting device could be used for picking up and transferring the auxiliary system from the boring machine 10 onto either a trailer or the ground beside the machine.

Although the present invention has been described with respect to several specific preferred embodiments, various changes, modifications, and substitutions of parts and elements may be suggested to one skilled in the art. Consequently, the invention should not be restricted to the above embodiments and it is intended that the present invention encompass such changes, modifications, and substitutions of parts and elements without departing from the spirit and scope of the invention.

What is claimed is:

1. A pipe handling device for storing and transporting pipe sections to and from a spindle axis of a horizontal boring machine, the pipe handling device comprising:

a support member having a first end and a second end and positioned such that the support member is located above the spindle axis and such that the first end is on a first side of the spindle axis and the second end is on a second side of the spindle axis;

a discharge point at the first end of the support member;

a magazine having a plurality of columns to receive and store pipe sections parallel to the spindle axis, the magazine being movable between a plurality of positions, the plurality of positions being defined by the position of the magazine when different columns of the magazine are aligned with the discharge point;

wherein the support member prevents pipe sections from being discharged from each of the plurality columns that stores a pipe section and is not aligned with the discharge point; and a transfer assembly moveable between at least a first position and a second position, the transfer assembly comprising: a pipe delivery member; and wherein in the first position the pipe delivery member is aligned with the discharge point and in the second position the pipe delivery member is aligned with the spindle axis.

2. The pipe handling device of claim 1 further comprising a drive assembly adapted to move the magazine to each of the plurality of positions.

3. The pipe handling device of claim 2 wherein the drive assembly comprises:

a first lever arm having a first end attached to the magazine and a second end; and a second lever arm having a first end pivotally connected to the magazine and a second end pivotally connected to the support member;

wherein the second end of said first lever arm is rotatably attached to the first end of said second lever arm.

4. The pipe handling device of claim 3 wherein the first lever arm is a hydraulic cylinder.

5. The pipe handling device of claim 2 wherein the lever assembly is adapted to move the magazine about a pivot point.

6. The pipe handling device of claim 1 wherein the transfer assembly further comprises a pipe grip adapted to retain a pipe section on the pipe delivery member.

7. The pipe handling device of claim 6, wherein the pipe grip further comprises a retaining member adjacent to the pipe delivery member that is movable between at least a first position in which a pipe section is retained on the pipe delivery member and a second position in which a pipe section is not secured on the pipe delivery member.

8. The pipe handling device of claim 7 wherein the retaining member is hydraulically activated.

9. The pipe handling device of claim 1 further comprising a pipe return assembly comprising:

a hydraulic cylinder;

a return arm operatively connectable to the cylinder;

wherein the operation of the cylinder causes the return arm to move at least one of the plurality of pipe sections into the magazine from the discharge point or from the magazine to the discharge point.

10. The pipe handling device of claim 1 wherein the magazine is removable and can be replaced with like magazines for storage and transportation of additional pipe sections.

11. The pipe handling device of claim 1, wherein the transfer assembly further comprises a blocking surface and wherein when the transfer assembly is in the second position the blocking surface is aligned with the discharge point.

12. The pipe handling device of claim 11 wherein the transfer assembly further comprises:

a hydraulic cylinder; and a transfer member operatively connected to the cylinder;

wherein the pipe delivery member is supported on the transfer member and the blocking surface is supported on the transfer member adjacent to the pipe delivery member.

13. The pipe handling device of claim 12 wherein the transfer member is pivotally movable between the first position and the second position.

14. The pipe handling device of claim 1 further comprising:

a pipe cartridge having a plurality of auxiliary columns to receive and store pipe sections, the cartridge positionable above the magazine such that the plurality of auxiliary columns align with columns of the magazine; and at least one load retainer removably positioned proximate a base of the cartridge and having a blocking surface which blocks discharge of pipe sections from the base.

15. The pipe handling device of claim 14 further comprising:

a load frame adapted to support a plurality of pipe sections; and a load transfer assembly adapted to move the load frame between a first position in which the plurality of pipe sections are in the cartridge and a second position in which the plurality of pipe sections are in the magazine.

16. The pipe handling device of claim 1 further comprising:

a load frame;

at least one column separator connectable to the load frame such that a plurality of pipe sections supported by the frame are aligned in a plurality of columns; and a load transfer assembly adapted to move the load frame between a first position in which the plurality of pipe sections are supported above the magazine and a second position in which the plurality of pipe sections are supported in the magazine.

17. A pipe handling device for storing and transporting pipe sections to and from a spindle axis of a horizontal boring machine, the pipe handling device comprising:

a magazine having a first side, an opposed second side, and a plurality of adjacent columns to receive and store pipe sections including a first column immediately adjacent the first side, the magazine moveable along a path of travel between an initial discharge position, in which the first column is aligned with a discharge point below the magazine, and a final discharge position, in which the column immediately adjacent the second side is aligned with the same discharge point, and having a footprint which overlays the spindle axis over at least a portion of the path of travel;

a base member positionable beneath the magazine and having a blocking surface which blocks discharge of pipes from the base in any column closer to the second side than the column aligned with the discharge point, while permitting a pipe in the column aligned with the discharge point to discharge from a base of the column and move to the discharge point; and a transfer system adapted to move a discharged pipe from the discharge point to the spindle axis.

18. The apparatus of claim 17, further comprising a dispensing system which limits and controls the discharge of pipes from each column.

19. The pipe handling device of claim 17 further comprising a drive assembly adapted to move the magazine throughout its path of travel.

20. The pipe handling device of claim 19 wherein the drive assembly comprises a hydraulic cylinder such that when the cylinder is retracted the magazine is in the initial discharge position and when the cylinder is extended the magazine is in the final discharge position.

21. The pipe handling device of claim 17 wherein the transfer system comprises a pipe delivery member adapted to support a pipe section.

22. The pipe handling device of claim 21 wherein the transfer system comprises a pipe grip adapted to retain the pipe section on the pipe delivery member.

23. The pipe handling device of claim 22 wherein the pipe grip comprises a spring loaded retaining member adjacent to the pipe delivery member that is movable between at least a first position in which a pipe section is retained on the pipe delivery member and a second position in which a pipe section is releasable from the pipe delivery member.

24. The pipe handling device of claim 18 wherein the dispensing system comprises:

a hydraulic cylinder;

a return arm operatively connectable to the cylinder;

wherein the operation of the cylinder causes the return arm to move at least one of the plurality of pipe sections into the magazine from the discharge point or from the magazine to the discharge point.

25. The pipe handling device of claim 17 wherein the transfer system further comprises:

a transfer member movable between a first position and a second position; and a hydraulic cylinder operatively connected to the transfer member;

wherein in the first position the transfer member is aligned with the discharge point and in the second position the transfer member is aligned with the spindle axis.

26. The pipe handling device of claim 25 wherein the transfer member is pivotally movable between the first position and the second position.

27. A method for transferring pipe sections to a horizontal boring machine from a magazine having a frame and defining a plurality of adjacent columns for storing pipe sections, the method comprising:

moving the magazine frame such that a column of the magazine containing pipe sections is aligned above a discharge point;

retrieving a pipe section from the discharge point;

moving the retrieved pipe section to the horizontal boring machine while blocking further pipe sections from being discharged to the discharge point; and maintaining any columns having pipe sections within tracks of the horizontal boring machine.

* * * * *